United States Patent [19]

Amann

[11] Patent Number: 4,629,185

[45] Date of Patent: Dec. 16, 1986

[54] UNIVERSAL HYDRAULIC EXERCISER

[76] Inventor: Michael J. Amann, 898 State Rd., 621 E., Lake Placid, Fla. 33852

[21] Appl. No.: 753,970

[22] Filed: Jul. 11, 1985

[51] Int. Cl.[4] ..... A63B 21/00

[52] U.S. Cl. ..... 272/130; 272/72; 272/134

[58] Field of Search ..... 272/72, 73, 93, 130, 272/134, 136, 143; 128/25 R, 25 B; 272/DIG. 4

[56] References Cited

U.S. PATENT DOCUMENTS

| | | | |
|---|---|---|---|
| 2,815,020 | 12/1957 | Barkschat | 128/25 R |
| 3,587,319 | 6/1971 | Andrews | 272/130 X |
| 4,235,437 | 11/1980 | Ruis et al. | 272/130 X |
| 4,452,447 | 6/1984 | Lepley et al. | 272/130 X |
| 4,477,071 | 10/1984 | Brown et al. | 272/134 X |

*Primary Examiner*—Richard J. Apley
*Assistant Examiner*—Robert W. Bahr
*Attorney, Agent, or Firm*—Macdonald J. Wiggins

[57] ABSTRACT

An exercise device has a pair of main hydraulic cylinders mounted in gimbals in a framework with hand grips attached to the distal ends of the cylinder rods. Resistance to movements of the rods is provided by an adjustable flow valve connected between the ports of the cylinders. Auxiliary hydraulic cylinders are provided connected between the framework and main cylinders to resist movements thereof in the vertical and horizontal directions. A chair is attached to the framework which permits the user to grasp the hand grips during exercise.

13 Claims, 6 Drawing Figures

FIG. 4
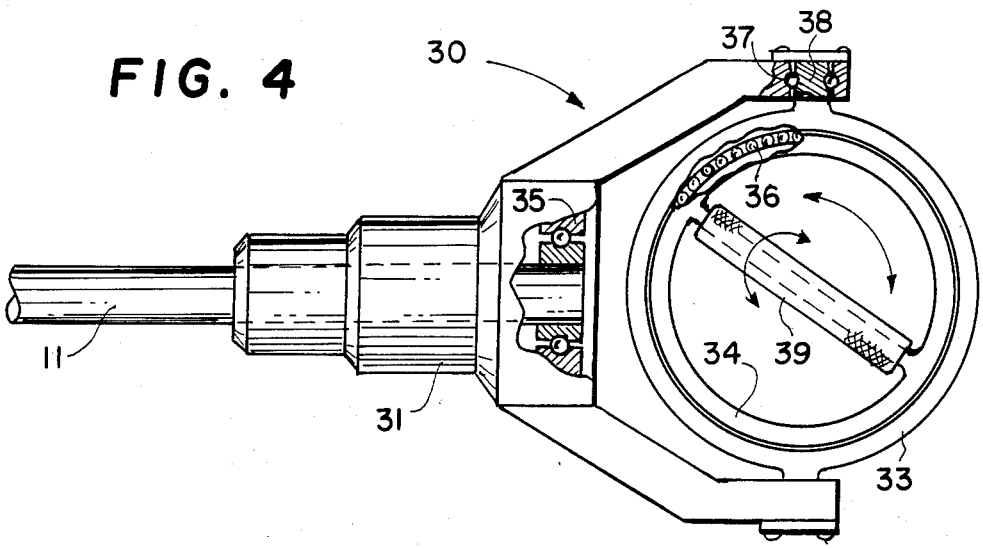
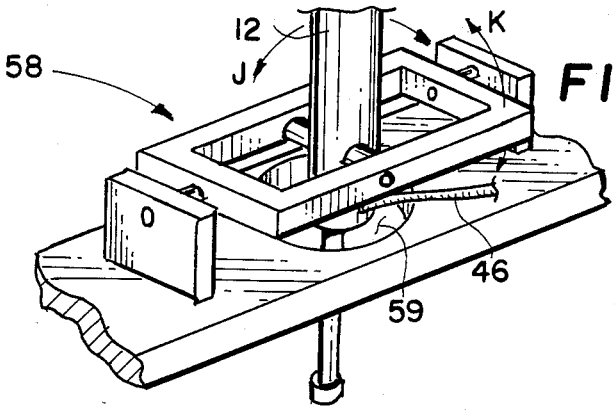
FIG. 5
FIG. 6
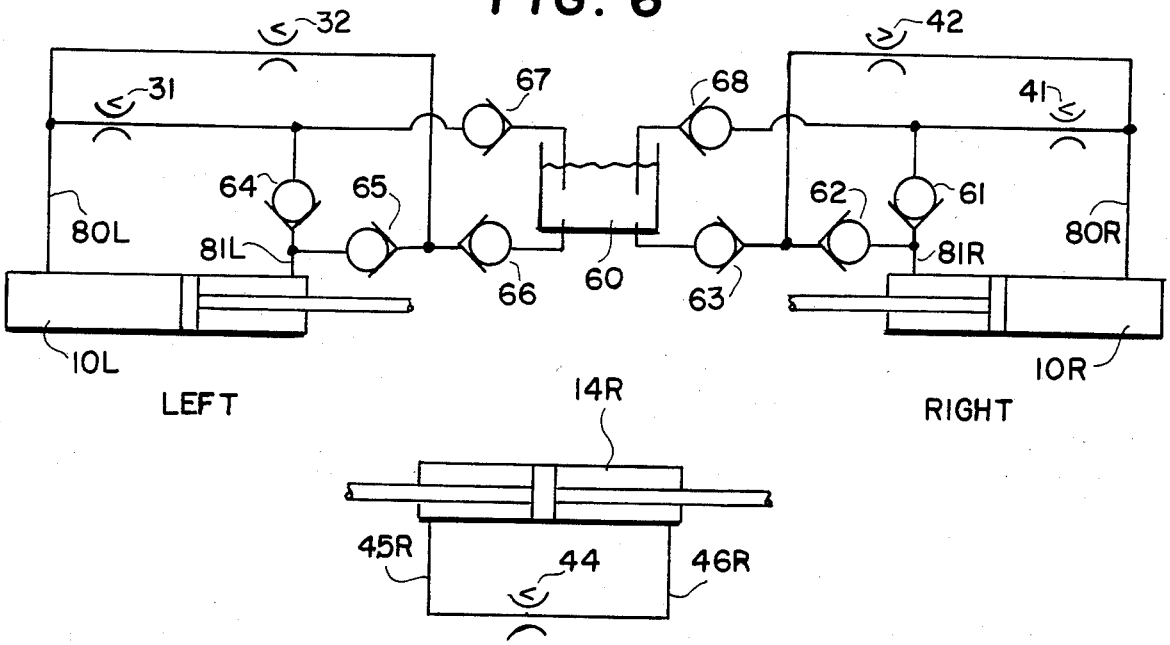

UNIVERSAL HYDRAULIC EXERCISER

BACKGROUND OF THE INVENTION

1. Field of the Invention

The present invention relates to exercise apparatus and more particularly to an apparatus which utilizes hydraulic pressure for resistance and is adjustable over a wide range.

2. Description of the Prior Art

With the current interest in personal fitness, a variety of machines and apparatus have been proposed to permit a user to exercise various muscles in the body. The majority of these utilize weights or springs to provide resistance during exercising. Although some machines have been proposed which utilize hydraulic and pneumatic devices to provide resistance, there is no known machine which will allow the user to obtain desired exercise movement in any desired direction and with very wide and fine control over the resistance.

Typical of relevant prior art apparatus are the devices described in the following U.S. Pat. Nos.: 4,465,274 to Davenport; 4,357,010 to Telle; 4,257,593 to Keiser; 3,587,319 to Andrews; 4,363,481 to Erickson; and 4,354,676 to Ariel. Both Davenport and Telle disclose devices which permit movements in a vertical plane against an adjustable hydraulic loop. Keiser also shows an exercise which uses vertical movement with a compressed gas system providing resistance. A universally mounted pole is moved against three hydraulic damper devices in the Andrews patent. Vertical lifting devices working against hydraulic cylinders are taught by Erickson and by Ariel.

None of the known prior art appears to disclose apparatus, that can provide movement in almost any plane and simultaneous movement in more than one plane. Thus, there is a need for a device having multiple hydraulic cylinders which are independently adjustable and that can provide exercise for selected groups of muscles.

SUMMARY OF THE INVENTION

The present invention utilizes a framework having a track arrangement in the foreground thereof. An adjustable chair is provided which rides in the track on suitable rollers and which can be fastened in place. The chair includes an adjustable seat and back positions so as to permit the user to assume almost any desired portion during exercise. The seat faces an upstanding framework having a left wing and a right wing. Each wing includes a gimbal with two degrees of freedom: vertical and horizontal. In the center of each gimbal, a trunnion is provided which mounts an elongated hydraulic cylinder having a single ended rod extending therefrom. The cylinder is centered in the trunnion and the rod extends forward toward the seat such that the user may push or pull on the rod. The cylinder is filled with hydraulic fluid and is connected through an adjustable flow valve such that the fluid is moved from one end of the cylinder to the other end as the rod is pushed in and out. A reservoir and check valve system is provided to compensate for the difference in volumes of the cylinder chambers due to the presence of the rod in the front chamber.

As will be understood, a pair of these hydraulic cylinders is used such that both hands may be used at the same time. To provide hand grips, the distal ends of each of the cylinder rods is provided with a yoke supporting a ring with a hand grip disposed within the ring and free to rotate within the ring. The yoke is also rotatable with respect to the shaft. Thus, a user seated in the chair may grasp the two handles and push and pull the rods inward and outward against the pressure created by means of the adjustable flow valves. The valves may be set to provide a desired resistance to the pulling and pushing action. The rotatable hand grips permit the hands to be held in any desired position since various groups of muscle will be exercised as the orientation of the grip is varied.

The gimbals are free to move in the horizontal and vertical direction which permits the user to move the positions of the hand grips both laterally and vertically. To provide resistance to such movements, a pair of double ended auxiliary hydraulic cylinders is disposed in each wing and connected between the framework and the cylinders. One cylinder is disposed horizontally and the other vertically. Each cylinder has its two chambers connected together through a controllable flow valve which is set to provide any desired resistance. Additionally, these flow valves may be turned completely off thereby locking the vertical and horizontal cylinders in any desired position for certain types of exercises.

As will now be recognized, the user may set the resistance of the main cylinder and the auxiliary horizontal and vertical cylinders to any degree of resistance desired from fully locked to completely free and can exercise through almost any desired type of muscle movement without the necessity of changing weights or the like. Advantageously, a control panel is mounted in the center of the frame with all of the flow control knobs within easy reach of the user and marked with calibrations such that a particular routine can be developed and quickly set up during an exercise period. The chair may be moved back and forth in the framework track and locked in a desired position dependent upon the exercise to be performed. It is adjustable with respect to the orientation of the seat and back. In addition to exercise with the hands, the chair may be placed in a reclining position and the feet coupled to the hand grips for exercising the legs. Many other variations will be apparent to the user.

It is therefore a principal object of the invention to provide a simple exercise apparatus having a wide range of resistance to movements selectably available to the user by utilizing a plurality of hydraulic cylinders with flow valves interconnecting the chambers thereof.

It is another object of the invention to provide exercise apparatus which does not require heavy weights and which can be adjusted to almost any desired resistance quickly and easily.

It is yet another object of the invention to provide an exercise machine which can be adjusted and which has a wide range of degrees of freedom such that almost any group of muscles may be exercised independently.

It is still another object of the invention to provide an exercise apparatus which does not require the use of a number of heavy weights or springs.

It is a further object of the invention to provide an exercise apparatus that is relatively compact and low cost yet will provide all the advantages of more elaborate exercise machines.

It is still another object of the invention to provide an exercise machine having hand grips which may be rotated to any position for the comfort of the user and which provide the ability to exercise different groups of muscles with the same types of movements.

These and other objects and advantages of the invention will become apparent from the following detailed description when read in conjunction with the drawings.

BRIEF DESCRIPTION OF THE DRAWINGS

FIG. 4 is a view of a typical hand grip assembly, partially cut away, for use with the invention shown in FIG. 1;

FIG. 5 is a partial view of an auxiliary hydraulic cylinder mounted in a gimball assembly; and FIG. 6 is a schematic of the hydraulic system for the various hydraulic cylinders of the invention showing the adjusting valve and check valve arrangements.

DETAILED DESCRIPTION OF THE PREFERRED EMBODIMENT

Figure 1:
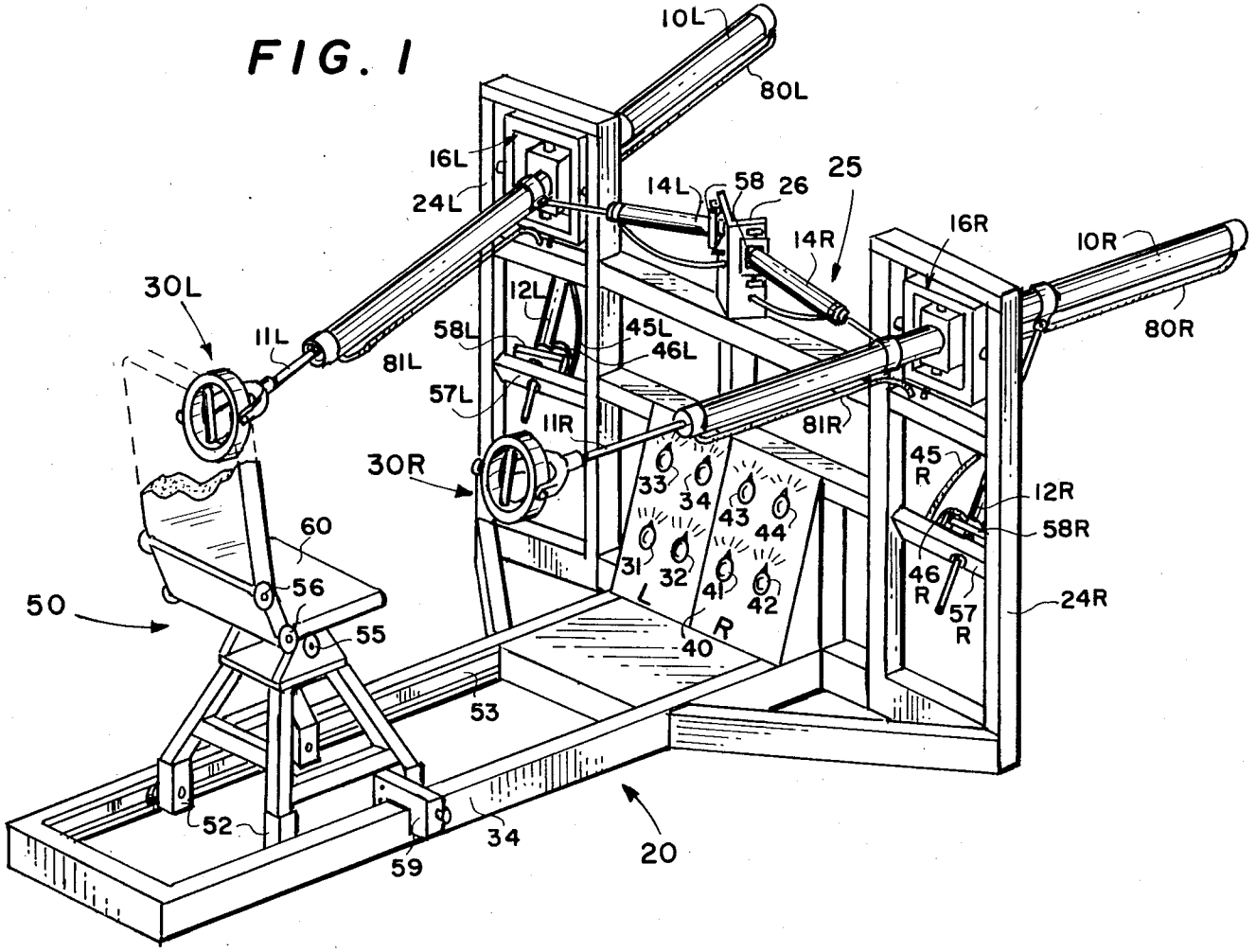
FIG. 1 is a perspective view of a preferred embodiment of the invention.

Referring to FIG. 1, a perspective view of a typical embodiment of the invention is shown. A framework 20 is provided having a forwardly extending track section 34 and a central framework 25. A left wing 24L and a right wing 24R are attached to central framework 25. Each wing includes a gimbal assembly 16 having vertical and horizontal degrees of freedom as will be shown in more detail hereinafter.

Left and right trunnions 70L and 70R are provided within gimbals 16L and 16R which support main cylinders 10L and 10R respectively secured in trunnions 70L and 70R. Cylinder rods 11L and 11R extends forward and may be moved within the cylinders 10L and 10R by means of hand grips 30L and 30R attached to the distal ends thereof.

A chair or seat assembly, shown generally at 50, is provided which includes rollers 52 attached to the legs thereof which will move in roller track 53 of track section 34. A clamp device 59 attached to chair 50 may be used to clamp the chair in a desired position along the track section 34. As will be recognized, a user sitting in the chair 50 may grasp the hand grips 30L and 30R and, by pushing and pulling, move rods 11L and 11R in and out. To provide resistance to such movement for exercise purposes, each hydraulic cylinder has line 81 and 80 from the front and rear chambers thereof connected to a pair of control valves 31 and 32. Cylinders 10L and 10R are filled with hydraulic fluid such that movement of a rod 11 will cause the piston in cylinder 10 to force the fluid from one chamber through the lines 80 and 81 and through a valve 31 and 32 depending upon the direction of motion. The setting of the valve will determine the amount of resistance encountered by the motion of rod 11. As will be explained in more detail hereinafter, valve 31 is effective when the motion of the rod is into the cylinder and valve 32 is effective when the motion of the rod is outward from the cylinder.

To provide resistance to vertical and horizontal movements of the cylinders 10 in gimbal assemblies 16, a pair of smaller auxiliary cylinders 14 and 12 are provided. Cylinders 14 are disposed horizontally having the bodies thereof attached to a bracket 26 on center frame 25 by means of gimbal assemblies 58. The rod of cylinder 14 is attached to cylinder 10. In a similar fashion, the body portion of cylinders 12 are each attached to a frame wing 24 by gimbal assemblies 58 and the rod is attached to the cylinder 10 with cylinder 12 vertically oriented. Each cylinder 12 and 14 has its chambers filled with hydraulic fluid and connected by hoses 45 and 46 to flow control valves 33, 34, 43 and 44. Cylinder 14R is connected to flow valve 44 and vertical cylinder 12R is connected to flow valve 43. Similarly, cylinder 14L is connected to flow valve 34 and cylinder 12L is connected to flow valve 33. As will be understood, adjustment of flow valves 33, 34, 43 and 44 will determine the amount of resistance felt when moving the associated main cylinders in a horizontal movement or a vertical movement.

A control panel 40 is provided at the base of center frame 24 convenient to a user which mounts control valves 31, 32, 33 and 34 for left cylinder 10L on a left portion thereof and control valves 41, 42, 43 and 44 on a right portion thereof.

As will also be seen from FIG. 1, chair 50 includes several adjustments including adjustment 55 which permits seat 60 to be tilted over a desired range and adjustments 56 which allows the back portion to be adjusted with respect to seat 60.

Figure 2:
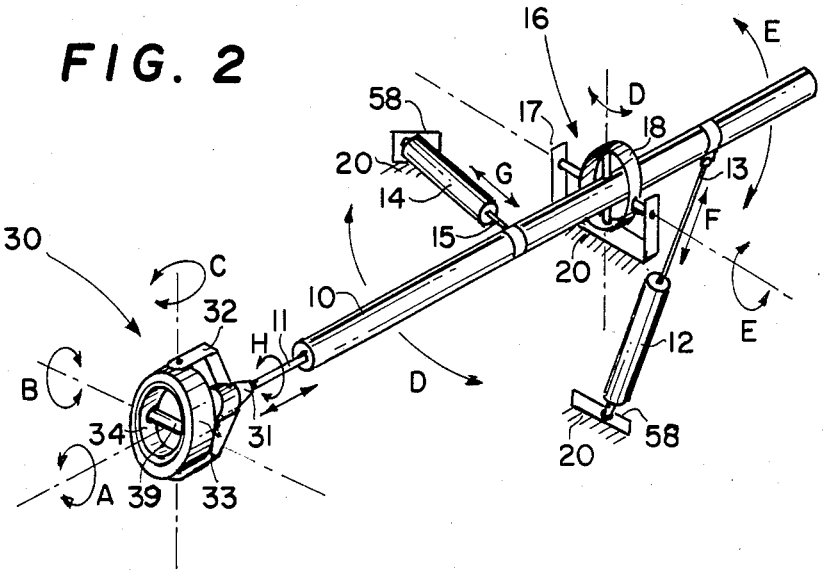
FIG. 2 is a schematic diagram of one main cylinder of the invention showing the various degrees of freedom and directions of motion which can be achieved with the apparatus of FIG. 1.

The various degrees of freedom of movement which the user has at his command is best seen with reference to the schematic diagram of FIG. 2 in which the ground symbol 20 represents the framework of the apparatus. As will be noted, the gimbal assembly 16 has a horizontal axis permitting movement of piston 10 in a vertical plane as indicated by arrows E. Gimbal 16 also has a vertical axis which permits movement of cylinder 10 in a horizontal plane as shown by arrows D. Obviously, this permits any desired angular movement of cylinder 10. As previously mentioned, the resistance to these two free directions of movement is controlled by adjustable flow control valves associated with cylinders 12 and 14 which are connected to the framework 20 by gimbal assemblies 58.

The user may move rod 11 in and out of cylinder 10 against a resistance controlled by the main cylinder valves as previously discussed and simultaneously move cylinder 10 angularly against a resistance controlled by the auxiliary cylinder valves. Hand grip assembly 30 attached to the distal end of rod 11 includes a yoke portion 32 and a bearing housing portion 31 which permits rotation of the grip assembly around the longitudinal axis of cylinder 10 as indicated by arrows A. Hand grip 39 mounted within rings 34 and 33 is rotatable about its axis as indicated by arrows B. Outer ring 33 is pivoted in yoke 32 about an axis which permits rotation as indicated by arrows C while inner ring 34 is rotatable within ring 33 permitting the rotation indicated by arrows A even if the grip 39 is not aligned with cylinder 10.

Figure 3:
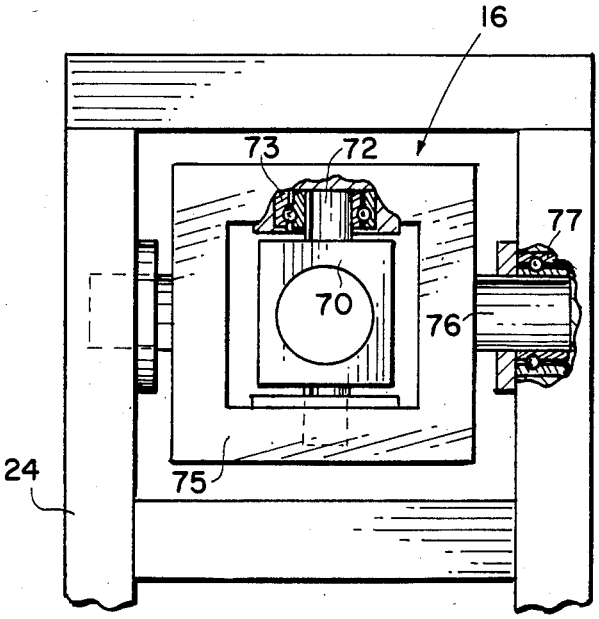
FIG. 3 is a view of the gimbal structure.

Turning now to FIG. 3, details of the gimbal assembly 16 are shown mounted in a wing 24. As will be noted, trunnion 70 includes an opening 71 for cylinder 10. Bearings 73 are provided for trunnion shaft 72 in inner gimbal frame 75. Gimbal frame 75 includes shafts 76 riding in bearings 77 in wing 24. As will be noted, large bearing surfaces are used since the exercises will present fairly heavy loads on these bearings.

FIG. 4 shows details of the preferred arangement of the hand grip assembly 30. Here, shaft 11 is shown disposed within bearing housing 31 which provides a bearing assembly 35 to permit the grip assembly to be rotated with respect to rod 11. Yoke 32 supports outer ring 33 having journals 38 attached thereto. Journals 38 ride in a bearing assembly 37 on each end thereof. Therefore, ring 33 may be easily rotated within yoke 32. An inner ring assembly 34 is supported within outer ring 33 by a bearing assembly 36 such that inner ring 34 rotates easily within outer ring 33. Grip 39 is preferably knurled to improve the gripping surface thereof and is mounted on a rod disposed across inner ring 34 such that grip 39 is rotatable thereon. Thus, grip 30 advantageously permits automatic orientation of the user's hands in a position most natural for the exercise being performed and will thereby prevent injury to wrists and ligaments as can easily occur when handling fixed weights.

FIGS. 5 shows a typical gimbal assembly 58 used to mount auxiliary cylinders 12 and 14 to framework 20 such that the cylinders may follow as cylinders 10 are moved. In the figure, a vertical cylinder 12 is attached to frame crosspiece 57 which has an opening 59 provided. Cylinder 12 has a double ended rod which extends through opening 59. As indicated, gimbal assembly 58 permits movement of cylinder 12 in the directions shown by arrows J and K.

FIG. 6 presents a schematic diagram of a typical hydraulic system in accordance with the invention. To minimize the length of cylinders 10L and 10R, it is desirable to use a single ended piston; thus, the volumes of the two chambers are not the same and a problem occurs in attempting to operate in a closed cylinder operation. Therefore, a reservoir 60 with appropriate check valves is provided to compensate for this difference in volume of the two sides. Additionally, check valves are used to permit independent adjustment of the resistance in cylinders 10L and 10R for each direction of movement. Referring to the left cylinder 10L, it may be noted that movement of the rod to the right causes fluid to flow out line 81L through check valve 65 thence to flow control valve 32 and back to the left chamber of the cylinder 10L. Since the volume of the right chamber of cylinder 10L is less than that of the left chamber, additional fluid is required to maintain the two chambers filled. Therefore, a small amount of fluid is drawn from reservoir 60 via check valve 66 to provide the extra fluid needed during the operation.

The reverse of this operation occurs when the piston is moved to the left which will force the fluid in the left chamber of cylinder 10L out through line 80L via flow control valve 31 and check valve 64 into the right hand chamber of cylinder 10L. Since more fluid will be moved that can be accepted by the right hand chamber, the excess is forced through check valve 67 back into reservoir 60. As previously described, flow valves 31 and 32 are adjustable such that the resistance to the flow of the fluid may be varied.

The other four cylinders are double shaft type as exemplifed by cylinder 14R shown in FIG. 6. In this instance, the volumes of the two chambers are equal when the piston is centered and therefore the check valve and reservoir arrangement for the main cylinders is not required. Therefore, line 45R is connected to flow valve 44 thence to the outer chamber of cylinder 14R via line 46R. Adjustment of flow valve 44 will give equal resistance to movement of the rod in either direction. This is in contrast to the arrangement for the main cylinders 10L and 10R in which a separate valve is provided through the use of check valves to permit independent adjustment of in and out movements when desired.

Although a particular arrangement and embodiment has been disclosed, this is for exemplary purposes only and its is to be understood that various modifications can be made to the disclosed implementation without departing from the spirit and scope of the invention.

I claim:

1. An exercise apparatus comprising:

a framework;

at least one gimbal assembly disposed in said framework;

a main hydraulic cylinder disposed in said gimbal assembly;

handle means attached to said main hydraulic cylinder for gripping by a user, said main hydraulic cylinder thereby movable vertically, horizontally with respect to said framework and longitudinally with respect to said main hydraulic cylinder by a user gripping said handle means, said hydraulic cylinder providing resistance to said longitudinal movements;

a first auxiliary hydraulic cylinder attached in an essentially horizontal position between said framework and said main hydraulic cylinder for providing resistance to said horizontal movement;

a second auxiliary hydraulic cylinder attached in an essentially vertical position between said framework and said main hydraulic cylinder for providing resistance to said vertical movements; and resistance control means for independently adjusting the resistance to said horizontal movement, said vertical movement, and said longitudinal movement.

2. The apparatus as recited in claim 1 in which said main hydraulic cylinder, said first auxiliary hydraulic cylinder, and said second auxiliary hydraulic cylinder each have an input port and an output port interconnected via an adjustable flow valve.

3. The apparatus as recited in claim 1 in which said main hydraulic cylinder includes a cylinder portion disposed in said gimbal assembly and a rod portion connected to said handle means.

4. The apparatus as recited in claim 3 in which said handle means includes:

a yoke portion rotatably connected to the distal end of said rod portion;

an outer ring pivotally disposed in said yoke portion;

an inner ring rotatably disposed in said outer ring, said inner ring having a cylindrical bar transverse to said inner ring; and a sleeve disposed over said bar.

5. The apparatus as recited in claim 4 in which said framework includes:

a horizontal frame;

an upright frame attached at one end of said horizontal frame, said upright frame having a left wing and a right wing; and a first main hydraulic cylinder disposed in a first said gimbal assembly in said left wing and a second main hydraulic cylinder disposed in a second said gimbal assembly in said right wing.

6. The apparatus as recited in claim 5 which further includes a chair attached to said horizontal frame facing said vertical frame.

7. The apparatus as recited in claim 6 in which said chair is movable along said horizontal frame.

8. The apparatus as recited in claim 6 in which said chair includes an adjustable back portion and an adjustable seat portion.

9. An exercise apparatus comprising:

a horizontal frame having a forward end and a rearward end;

a vertical frame attached to said rearward end of said horizontal frame, said vertical frame having a left wing and a right wing;

a first gimbal assembly disposed in said left wing and a second gimbal assembly disposed in said right wing;

a first main hydraulic cylinder having a first forwardly extending rod and disposed in said first gimbal assembly and a second main hydraulic cylinder having a second forwardly extending rod and disposed in said second gimbal assembly;

a first pair of adjustable flow valves connected between an input port and an output port of said first main hydraulic cylinder, and a second pair of adjustable flow valves connected between an input port and an output port of said second main hydraulic cylinder;

a first auxiliary hydraulic cylinder disposed essentially horizontally and operatively connected between said first main hydraulic cylinder and said vertical frame and having a third adjustable flow valve connected between an input port and an output port of said first auxiliary hydraulic cylinder;

a second auxiliary hydraulic cylinder disposed essentially vertically and operatively connected between said first main hydraulic cylinder and said vertical frame, and having a fourth adjustable flow valve connected between an input port and an output port of said second auxiliary hydraulic cylinder;

a third auxiliary hydraulic cylinder disposed essentially horizontally and connected between said second main hydraulic cylinder and said vertical frame, and having a fifth adjustable flow valve connected between an input port and an output port of said third auxiliary hydraulic cylinder;

a fourth auxiliary hydraulic cylinder disposed essentially vertically and connected between said second main hydraulic cylinder and said vertical frame, and having a sixth adjustable flow valve connected between an input port and an output port of said fourth auxiliary hydraulic cylinder;

a first handle assembly attached to a distal end of said first rod and a second handle assembly attached to a distal end of said second rod;

whereby said first and second rods can each be selectively moved forwardly and rearwardly, and said first and second main hydraulic cylinders can each be selectively moved vertically and horizontally by a user grasping said first and second handle assemblies.

10. The apparatus as recited in claim 9 which further comprises a chair adjustably disposed on said horizontal frame.

11. The apparatus as recited in claim 11 in which said chair includes an adjustable seat and an adjustable back.

12. The apparatus as recited in claim 9 in which each of said auxiliary cylinders is attached to said vertical frame by a gimbal mount.

13. The apparatus as recited in claim 9 in which said first and second handle assemblies are rotatable with respect to the respective ones of said rods.

* * * * *